US011634959B2

(12) United States Patent
Maher et al.

(10) Patent No.: US 11,634,959 B2
(45) Date of Patent: Apr. 25, 2023

(54) REMOTELY OPERABLE RETRIEVABLE DOWNHOLE TOOL WITH SETTING MODULE

(71) Applicant: Halliburton Energy Services, Inc., Houston, TX (US)

(72) Inventors: Peter Reid Maher, Lafayette, LA (US); Jon-Howard Elliott Hanson, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/461,360

(22) Filed: Aug. 30, 2021

(65) Prior Publication Data

US 2023/0069763 A1 Mar. 2, 2023

(51) Int. Cl.

| | |
|---|---|
| ***E21B 23/06*** | (2006.01) |
| ***E21B 47/10*** | (2012.01) |
| ***E21B 47/06*** | (2012.01) |
| ***E21B 41/00*** | (2006.01) |

(52) U.S. Cl.

CPC ..... *E21B 23/06* (2013.01); *E21B 41/0085* (2013.01); *E21B 47/06* (2013.01); *E21B 47/10* (2013.01)

(58) Field of Classification Search

CPC ..... E21B 23/06; E21B 41/0085; E21B 47/06; E21B 47/10

See application file for complete search history.

(56) References Cited

U.S. PATENT DOCUMENTS

| | | | | |
|---|---|---|---|---|
| 5,113,379 | A * | 5/1992 | Scherbatskoy | E21B 47/12 367/83 |
| 5,343,963 | A | 9/1994 | Bouldin et al. | |
| 6,536,530 | B2 | 3/2003 | Schultz et al. | |
| 6,684,953 | B2 | 2/2004 | Sonnier | |
| 7,201,230 | B2 | 4/2007 | Schultz et al. | |
| 9,347,268 | B2 | 5/2016 | Grigor et al. | |
| 9,719,304 | B2 | 8/2017 | Radford et al. | |
| 10,544,648 | B2 | 1/2020 | Costa De Oliveira et al. | |
| 10,563,471 | B2 | 2/2020 | Georgsen et al. | |
| 11,125,037 | B2 * | 9/2021 | Greci | E21B 47/06 |

(Continued)

FOREIGN PATENT DOCUMENTS

| | | |
|---|---|---|
| WO | 2012082304 | 6/2012 |
| WO | 2015085427 A1 | 6/2015 |

OTHER PUBLICATIONS

International Application, International Search Report and Written Opinion, PCT/US2021/048473, dated May 19, 2022, 10 pages.

*Primary Examiner* — Steven A MacDonald
(74) *Attorney, Agent, or Firm* — Kilpatrick Townsend & Stockton LLP

(57) ABSTRACT

A setting module for setting a packer assembly in a wellbore can include a motor, a sensor, and an electronic control device. The sensor can detect pressure of fluid from a surface of the wellbore in an inner diameter of the setting module and output detected pressure to an electronic control device. The electronic control device can detect a triggering pressure sequence of the fluid from the surface and can, in response to detecting the triggered pressure sequence, output a command to the motor to drive a pump to cause a slip to move for setting the packer assembly.

20 Claims, 6 Drawing Sheets

(56) References Cited

U.S. PATENT DOCUMENTS

| | | | | |
|---|---|---|---|---|
| 2002/0096325 | A1* | 7/2002 | Sonnier | E21B 47/18 166/387 |
| 2004/0055755 | A1* | 3/2004 | Roesner | E21B 23/06 166/120 |
| 2013/0341048 | A1* | 12/2013 | Delgado | E21B 23/01 166/117.6 |
| 2017/0081938 | A1* | 3/2017 | Richards | E21B 47/007 |
| 2017/0081940 | A1* | 3/2017 | Themig | E21B 23/06 |
| 2017/0275962 | A1* | 9/2017 | Conzemius | E21B 34/066 |
| 2017/0284168 | A1* | 10/2017 | Zevenbergen | E21B 33/1272 |
| 2020/0088001 | A1 | 3/2020 | Morland | |
| 2020/0030892 | A1 | 10/2020 | Greci et al. | |
| 2020/0308922 | A1* | 10/2020 | Greci | E21B 23/06 |
| 2021/0310329 | A1* | 10/2021 | Hrupp | E21B 43/267 |

* cited by examiner

REMOTELY OPERABLE RETRIEVABLE DOWNHOLE TOOL WITH SETTING MODULE

TECHNICAL FIELD

The present disclosure relates generally to wellbore tools and, more particularly (although not necessarily exclusively), to a retrievable downhole tool that can be remotely operable and that includes a setting module.

BACKGROUND

A wellbore can be formed in a subterranean formation for extracting produced hydrocarbon material and other suitable material. Various wellbore operations can be performed with respect to the wellbore. For example, the wellbore operations can include drilling (e.g., forming the wellbore), stimulation (e.g., hydraulic fracturing or other similar stimulation operation), production, and other suitable wellbore operations. In some examples, the wellbore operations can involve using one or more tools downhole in the wellbore. The tools can include, for example, packers or other suitable downhole tools. Before using the tools downhole, the tools may need to be set or otherwise set up in the wellbore. Other retrievable downhole tools may be set in the wellbore using ineffective or damaging techniques. For example, the other retrievable downhole tools may include drag blocks that may damage a casing or wall of the wellbore. It may be difficult to control a setting process with respect to the other retrievable downhole tools. Additionally, it may be difficult to cause the other retrievable downhole tools to set or to be unset.

DETAILED DESCRIPTION

Figure 1:
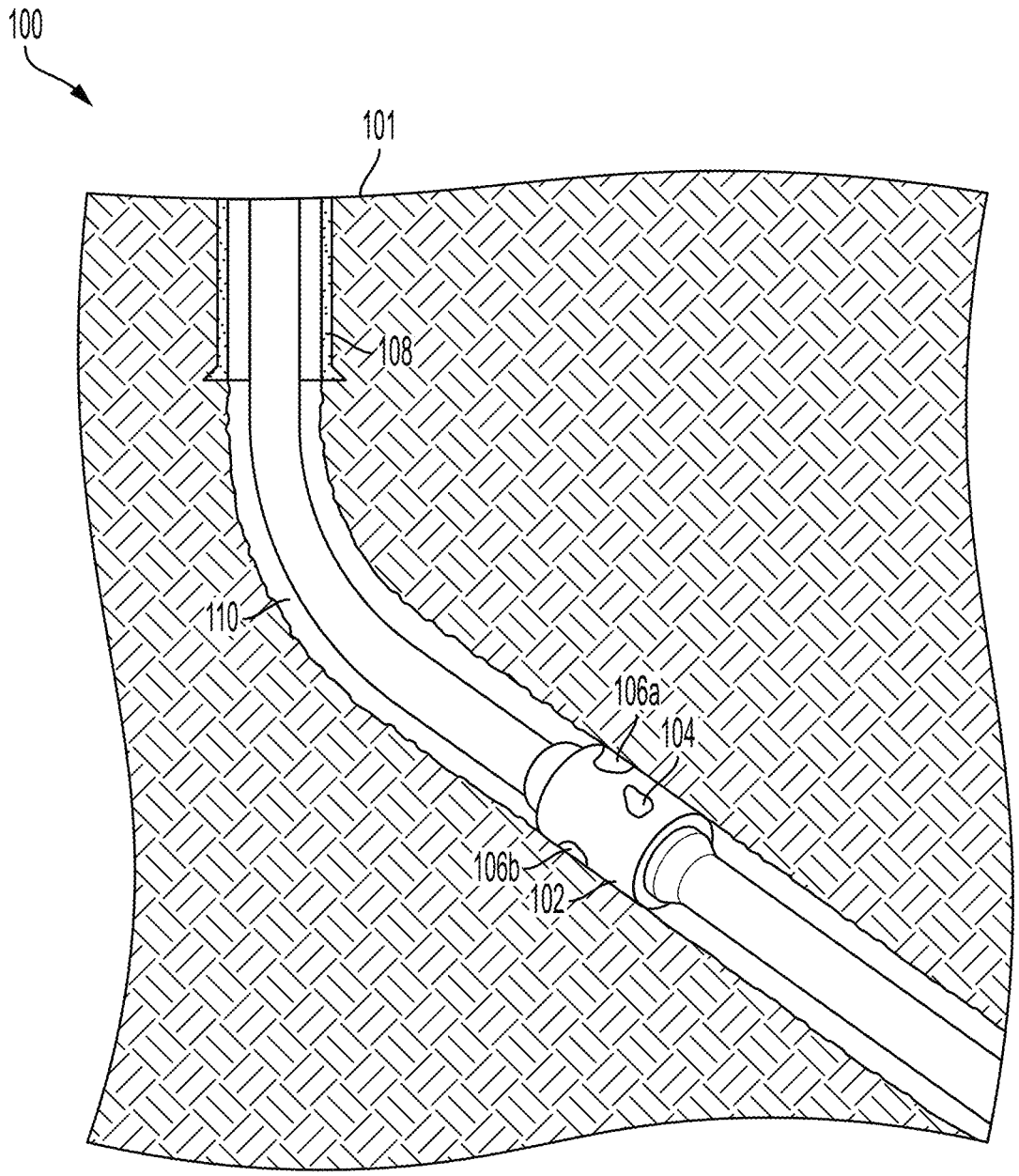
FIG. 1 is a schematic of a wellbore that includes a remotely operable retrievable downhole tool that includes a setting module according to one example of the present disclosure.

Certain aspects and examples of the present disclosure relate to a remotely operable retrievable downhole tool that includes a setting module. The retrievable downhole tool can be positioned in a wellbore and can be set for performing one or more wellbore operations. The retrievable downhole tool can include a retrievable service packer, a bridge plug, or other suitable retrievable downhole tools for performing wellbore operations. The setting module can include a motor, a sensor, and an electronic control device. Additionally, the setting module can include a piston, a pump, a gearbox, a spring, one or more mechanical slips, and other suitable components for the setting module. The sensor can include a pressure transducer, a flow sensor, or other suitable sensor, and can receive a triggering pressure sequence. The electronic control device can include a printed circuit board, or other suitable electronic control device, and can cause the motor to engage and to cause the mechanical slips of the retrievable downhole tool to actuate. The motor can use the pump, the gearbox, and other suitable component of the setting module to actuate the mechanical slips by displacing fluid in the piston. Actuating the mechanical slips of the remotely operable retrievable downhole tool can involve moving the mechanical slips outward to apply a pre-setting force on a wall or casing of the wellbore. In response to actuating the mechanical slips, a setting force can be applied to the retrievable downhole tool from the surface to set the retrievable downhole tool. The setting force can be removed from the retrievable downhole tool to unset the retrievable downhole tool for repositioning, removal, or other suitable operations with respect to the retrievable downhole tool.

Some compression set retrievable tools can use one or more drag blocks and a J-slot mechanism to perform setting operations, unsetting operations, or a combination thereof. Providing adequate drag force in a variety of fluid conditions to enable repeatable setting and unsetting operations to occur using the drag blocks may be ineffective or may otherwise cause damage to a wellbore. In some examples, more force may be used to reliably set bi-directional slips than drag blocks can provide, so a system that can include a set of mechanical slips can be run on the retrievable tool to aid in the setting process. This technique may be successful but also may be expensive or difficult due to the mechanical slip components. Additionally, damage can occur with respect to the inner diameter of the wellbore casing via the drag blocks, which may be pushed radially into the inner diameter of the wellbore casing with a stack of leaf springs under each drag block. The drag blocks may drag along the inner diameter of the target casing of the wellbore until a setting location of the tool is reached.

Using a setting module in a retrievable downhole tool may improve setting performance over other compression set retrievable tools. The setting module can be self-contained and can recognize a predetermined pressure signature created by intentionally fluctuating flowrates across the retrievable downhole tool to activate an internal pump. The operation sequence to set a retrievable tool can include circulating fluid for a few minutes once the retrievable downhole tool is at a setting location to clean debris from the setting location. The circulation can be performed in a one or more orders by stepping flowrates of the fluid at specified, or otherwise predetermined, time intervals to create the predetermined pressure signature. Once the predetermined pressure signature is recognized, the internal pump can drive a piston that can pre-set mechanical slips of the retrievable downhole tool into the inner diameter of the wellbore casing. The retrievable downhole tool can be fully set by slacking off set down weight from above the retrievable downhole tool or hang weight below the retrievable downhole tool. In some examples, the retrievable downhole tool can be set by applying a setting force from the surface of the wellbore. The retrievable downhole tool can be retrieved by removing the weight, or the applied force, and, in response to removing the weight or the applied force, the retrievable downhole tool may reset to an original, or unset, position. In some examples, using the setting module may allow the retrievable downhole tool to function without drag blocks or without additional external equipment for transmitting signals (e.g., wires, control lines, repeaters, etc.).

The remotely operable retrievable downhole tool can aid or allow operation of setting tandem bridge plugs since the remotely operable retrievable downhole tool may not include J-slots. Additionally, the remotely operable retrievable downhole tool can prevent an accidental set of the tandem bridge plugs, which can cause safety or economic concerns. The remotely operable retrievable downhole tool may not include drag blocks and, accordingly, may mitigate or otherwise eliminate damage to the casing of the wellbore during setting or unsetting operations. Additionally, when used in some applications (e.g., bridge plug applications, etc.), the remotely operable retrievable downhole tool can reduce cost associated with a mechanical slip sub-system associated with the remotely operable retrievable downhole tool.

Mechanical slips of the retrievable downhole tool can be kept in a run-in-hole (RIH) position by a piston biased in one direction by a spring. The retrievable downhole tool can include an onboard pressure transducer that can detect minor pressure fluctuations as fluid is circulated around the retrievable downhole tool. The retrievable downhole tool can restrict flow once the fluid is inside the target casing inner diameter. The fluctuations can be monitored and, when a triggering pressure sequence is detected, a signal can be processed by an electronic control device (e.g., a printed circuit board or other suitable electronic control device) and can be transmitted to a motor to drive an internal pump that can displace fluid inside the retrievable downhole tool to drive the piston upwards towards the mechanical slips. The electronic components can be powered by one or more batteries, or other suitable power sources, positioned on the retrievable downhole tool. The internal fluid can be pressure-compensated by a balance piston. A first amount of force can be generated by the piston to obtain a second, relatively small, force applied by the mechanical slips on the casing of the wellbore. The second force can provide enough resistance that a third force can be mechanically applied by slacking off weight at surface to fully set the retrievable downhole tool. When retrieval or repositioning of the retrievable downhole tool is desired, the weight can be picked up, or otherwise removed, to unset the retrievable downhole tool. Once the mechanical slips are released from the casing of the wellbore, the spring can return the mechanical slips to the RIH position by pushing the piston back to an original position of the piston. The retrievable downhole tool can be set and unset repeatedly by performing the above techniques.

The above illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a schematic of a wellbore 100 that includes a remotely operable retrievable downhole tool 102 that includes a setting module 104 according to one example of the present disclosure. In the illustrated example, one remotely operable retrievable downhole tool 102 is illustrated, but other suitable numbers of remotely operable retrievable downhole tools 102 for performing wellbore-related tasks may be included. The setting module 104 can include a motor, a sensor, and an electronic control device. The setting module 104 can additionally include a spring, a piston, a pump, one or more mechanical slips, other suitable components, or a combination thereof for remotely operating the retrievable downhole tool 102.

At a setting, or otherwise desired, depth, the remotely operable retrievable downhole tool 102 can be subjected to a series of pressure signals generated by varying fluid flowrates. The fluid can be flowed downhole, for example from the surface 101 of the wellbore 100, at one or more flowrates and through the remotely operable retrievable downhole tool 102 such that the sensor of the setting module 104 can detect minor differences in pressure or flowrate of the fluid. In some examples, the setting module 104 can detect the pressure or flowrate of the fluid in an inner diameter of the setting module 104. Circulating the fluid can include cleaning debris from the retrievable downhole tool 102, from the setting depth, or a combination thereof. The pressure or flowrate signals can include a triggering pressure sequence. The triggering pressure sequence can include a predetermined sequence of pressures or flowrates that indicate a request to commence a setting process. In response to receiving the triggering pressure sequence, the setting module 104 can cause mechanical slips 106*a-b* to move into a pre-set position, which may involve the mechanical slips 106 partially actuating. The mechanical slips 106*a-b* may contact a casing 108 or a wall 110 of the wellbore 100 upon partially actuating, but if the mechanical slips 106*a-b* partially actuate and contact the casing 108 or the wall 110 of the wellbore 100, the mechanical slips 106*a-b* may not apply a setting force on the casing 108 or the wall 110.

Once the mechanical slips 106 are in the pre-set position, a setting weight or force can be applied to the remotely operable retrievable downhole tool 102, which can cause the retrievable downhole tool 102 to be moved or otherwise adjusted into a set configuration in the wellbore 100. The setting weight or force can be applied from the surface 101 of the wellbore 100. Additionally or alternatively, the setting weight or force can be applied by slacking off hang weight below the remotely operable retrievable downhole tool 102. The set configuration can involve further actuating the mechanical slips 106*a-b* such that the mechanical slips 106*a-b* apply a setting force on a casing 108 or wall 110 of the wellbore 100. The remotely operable retrievable downhole tool 102 can be retrieved by removing the setting weight or force, and removing the setting weight or force can cause the mechanical slips 106*a-b* to be returned to a run-in-hole (RIH) configuration, which may involve the mechanical slips 106*a-b* retracting from the casing 108 or from the wall 110, for repositioning or removing the retrievable downhole tool 102 with respect to the wellbore 100.

Figure 2:
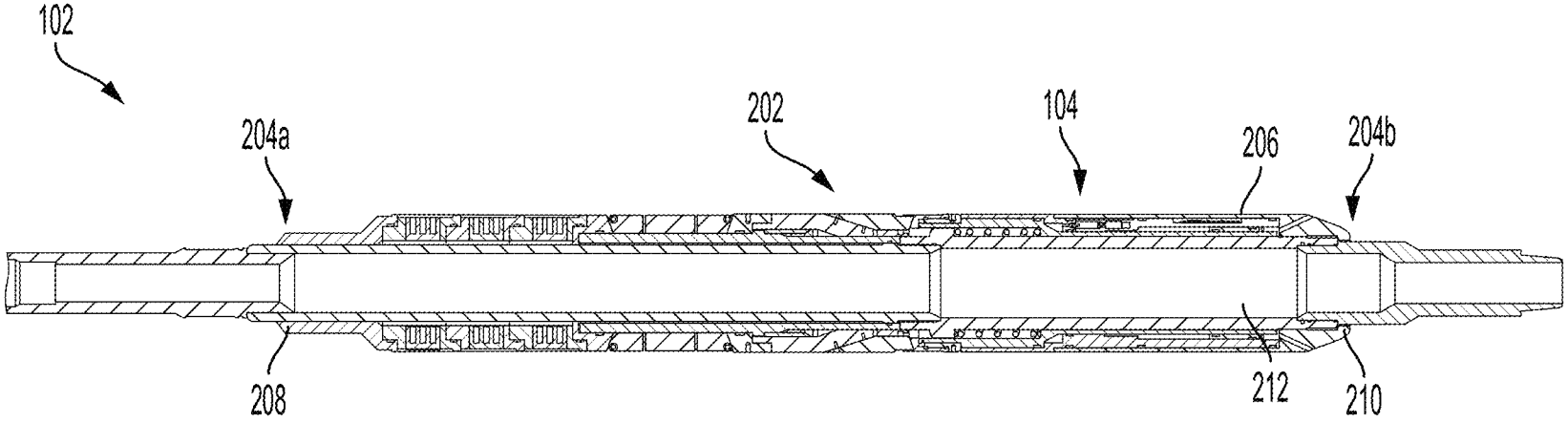
FIG. 2 is a sectional side-view of a remotely operable retrievable downhole tool according to one example of the present disclosure.

FIG. 2 is a sectional side-view of a remotely operable retrievable downhole tool 102 according to one example of the present disclosure. The remotely operable retrievable downhole tool 102 can include the setting module 104, a mechanical slip assembly 202, and adapters 204*a-b*. The mechanical slip assembly 202 can include one or more mechanical slips (e.g., the mechanical slips 106*a-b*), and other suitable components for allowing the mechanical slips to be actuated for setting the retrievable downhole tool 102. The adapters 204*a-b* can allow the retrievable downhole tool 102 to be affixed or otherwise coupled to a toolstring, workstring, or other suitable component for positioning the retrievable downhole tool 102 in the wellbore 100. In some examples, the setting module 104 and the mechanical slip assembly 202 can be positioned on an exterior surface 206 of the retrievable downhole tool 102. Additionally, the adapters 204*a-b* can be positioned at opposing distal ends of the retrievable downhole tool 102. For example, when the retrievable downhole tool 102 is positioned in a vertical wellbore, the adapter 204*a* may be positioned at a top end 208 of the retrievable downhole tool 102, and the adapter 204*b* may be positioned at a bottom end 210 of the retrievable downhole tool 102.

Fluid can be flowed with respect to the remotely operable retrievable downhole tool 102. In one such example, fluid can be flowed into the wellbore 100 from the surface 101 of the wellbore 100 and into an interior region 212 of the retrievable downhole tool 102. Additionally, other fluid (e.g., mud, etc.) can be flowed around or across the exterior surface 206 of the retrievable downhole tool 102. The fluid can be flowed in other suitable locations for communicating pressure or flowrate signal sequences. The setting module 104 can detect pressure associated with the fluid. For example, the setting module 104 can detect the fluid pressure of fluid flowing in the interior region 212, flowing across the exterior surface 206, or a combination thereof. In cases in which fluid is flowing both in the interior region 212 and across the exterior surface 206, the setting module 104 can detect a differential pressure between the interior region 212 and the exterior surface 206.

Figure 3:
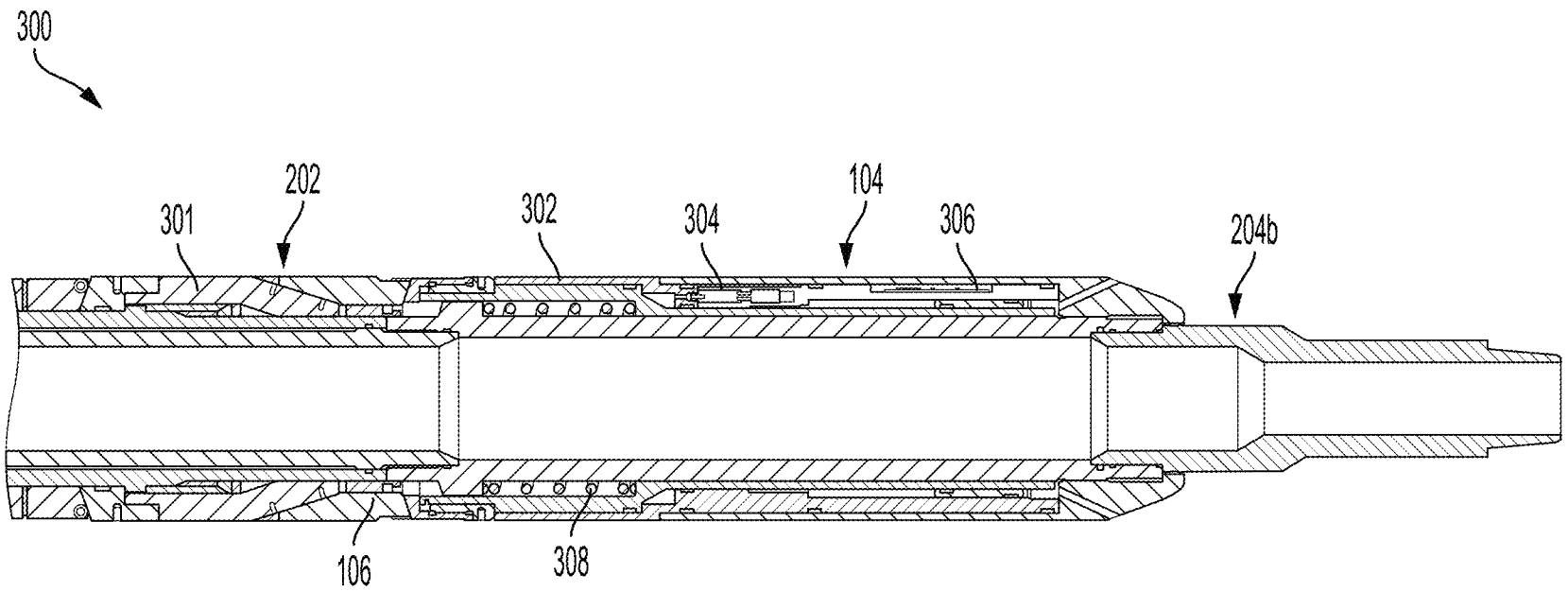
FIG. 3 is a sectional side-view of a lower portion of a remotely operable retrievable downhole tool that includes a setting module according to one example of the present disclosure.

FIG. 3 is a sectional side-view of a lower portion 300 of the remotely operable retrievable downhole tool 102 that includes a setting module 104 according to one example of the present disclosure. The retrievable downhole tool 102 can include the adapter 204*b* and the mechanical slip assembly 202, which can include one or more mechanical slips 106 and a slip guide 301. The setting module 104 can include a piston 302, a pump assembly 304, an electrical assembly 306, and a spring 308. The piston 302 can be positioned around, or otherwise adjacent to, the spring 308 such that, when actuated, the piston 302 can receive spring force from the spring 308. The pump assembly 304 can be positioned between the piston 302 and the electrical assembly 306. In some examples, the pump assembly 304 can be operably coupled, or otherwise adjacent, to the piston 302 such that the pump assembly 304 can apply pressure or perform other suitable operations with respect to the piston 302. Additionally, the piston 302 can be positioned between the mechanical slip assembly 202 and the pump assembly 304.

In an RIH configuration, the spring 308 may prevent the mechanical slip assembly 202 from accidentally or prematurely actuating, which may cause damage in the wellbore 100. Once the remotely operable retrievable downhole tool 102 is positioned in the wellbore 100 at a setting location, the electrical assembly 306, which can include a sensor such as a pressure transducer or flowrate sensor, can receive the triggering pressure sequence. Prior to receiving the triggering pressure sequence, the electrical assembly 306 may receive other sequences of pressure signals, which may correspond to fluid flowing through or around the retrievable downhole tool 102 to clean the setting location or for other suitable purposes. In response to receiving the triggering pressure sequence, the electrical assembly 306 may cause the pump assembly 304 to interact with the piston 302. For example, the pump assembly 304 can displace fluid in the piston 302 to cause the mechanical slip assembly 202 to actuate. The mechanical slip assembly 202 actuating can involve the slip guide 301 moving to actuate the mechanical slips 106. For example, the mechanical slips 106 may move outward into a pre-set configuration. The mechanical slip 106 may contact the casing 108 or the wall 110 of the wellbore 100, but any force applied by the mechanical slip 106 in the pre-set configuration may not be enough force to set the retrievable downhole tool 102 or to otherwise cause the retrievable downhole tool 102 to move into a set configuration. Additionally, by actuating, the mechanical slip assembly 202 may cause the spring 308 to compress.

Once the mechanical slips 106 are in the pre-set configuration, the setting force can be applied to the remotely operable retrievable downhole tool 102. The setting force can be applied from the surface 101 and can cause the retrievable downhole tool 102 to move into the setting configuration. The setting configuration can involve the mechanical slips 106 applying a force on the casing 108 or the wall 110 of the wellbore 100. Additionally, once in the setting configuration, the retrievable downhole tool 102 can be used to perform, or can allow performance of, one or more wellbore operations. The setting force can be removed, which can cause the mechanical slips 106 to retract from the casing 108 or the wall 110, and the spring 308 can apply a spring force for returning the retrievable downhole tool 102 to the RIH configuration.

Figure 4:
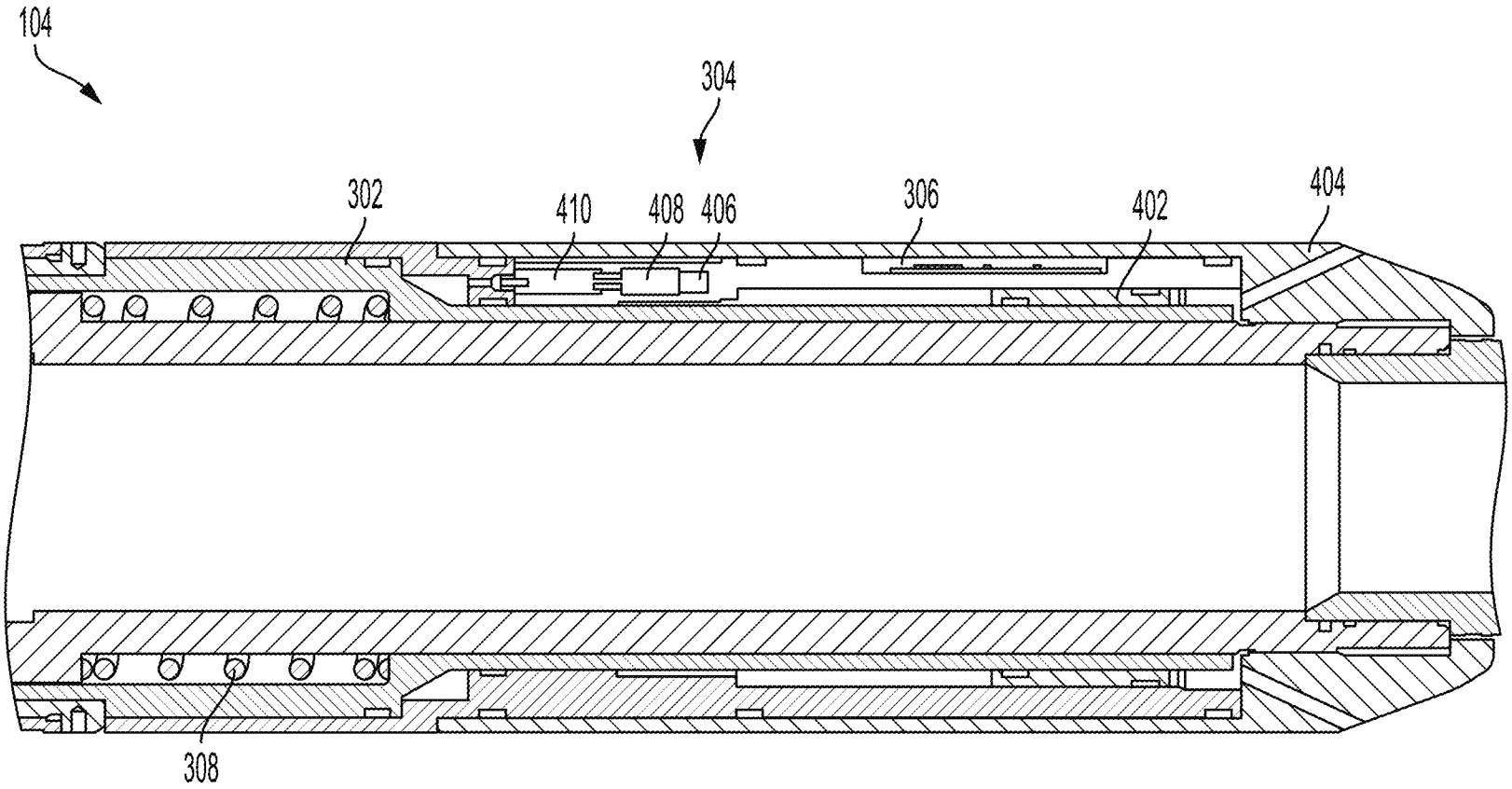
FIG. 4 is a sectional side-view of a setting module of a remotely operable retrievable downhole tool according to one example of the present disclosure.

FIG. 4 is a sectional side-view of the setting module 104 of a remotely operable retrievable downhole tool 102 according to one example of the present disclosure. The setting module 104 can include the piston 302, the pump assembly 304, the electrical assembly 306, and the spring 308. The setting module 104 can additionally include a balance piston 402 and flow ports 404. The balance piston 402 can be positioned proximate to, or otherwise adjacent to, the internal region 312 of the retrievable downhole tool 102. The balance piston 402 can compensate for internal fluid pressure with respect to the retrievable downhole tool 102. The flow ports 404 can be positioned at the bottom end 210 of the retrievable downhole tool 102. The flow ports 404 can prevent pressure-locking with respect to the retrievable downhole tool 102. For example, the flow ports 404 can allow the annulus to exert pressure on the retrievable downhole tool 102 to balance pressure and prevent locking in the wellbore 100.

The pump assembly 304 can include a motor 406, a gearbox 408, and a pump 410. The motor 406 can be communicatively coupled to electrical portions (e.g., the electrical assembly 306, a sensor, an electronic control device, etc.) of the retrievable downhole tool 102. The gearbox 408 can be positioned between, and adjacent to, the motor 406 and the pump 410. The pump 410 can be positioned between the piston 302 and the gearbox 408. The motor 406 can control the gearbox 408 and the pump 410, which can apply pressure or force (e.g., hydraulic force, etc.) with respect to the piston 302. For example, the motor 406 can receive a signal from the electrical portions to displace fluid in the piston 302, and in response to receiving the signal, the motor 406 can engage the gearbox and control the pump 410 to displace the fluid. The motor 406 may run for a predetermined amount of time. For example, in response to receiving the signal, the motor 406 may run for the predetermined amount of time for allowing the setting force to be applied to the retrievable downhole tool 102. Once the predetermined amount of time expires, the motor 406 may shut off, to allow removal of the setting force and repositioning or retrieval of the retrievable downhole tool 102, until receiving an additional signal.

Figure 5:
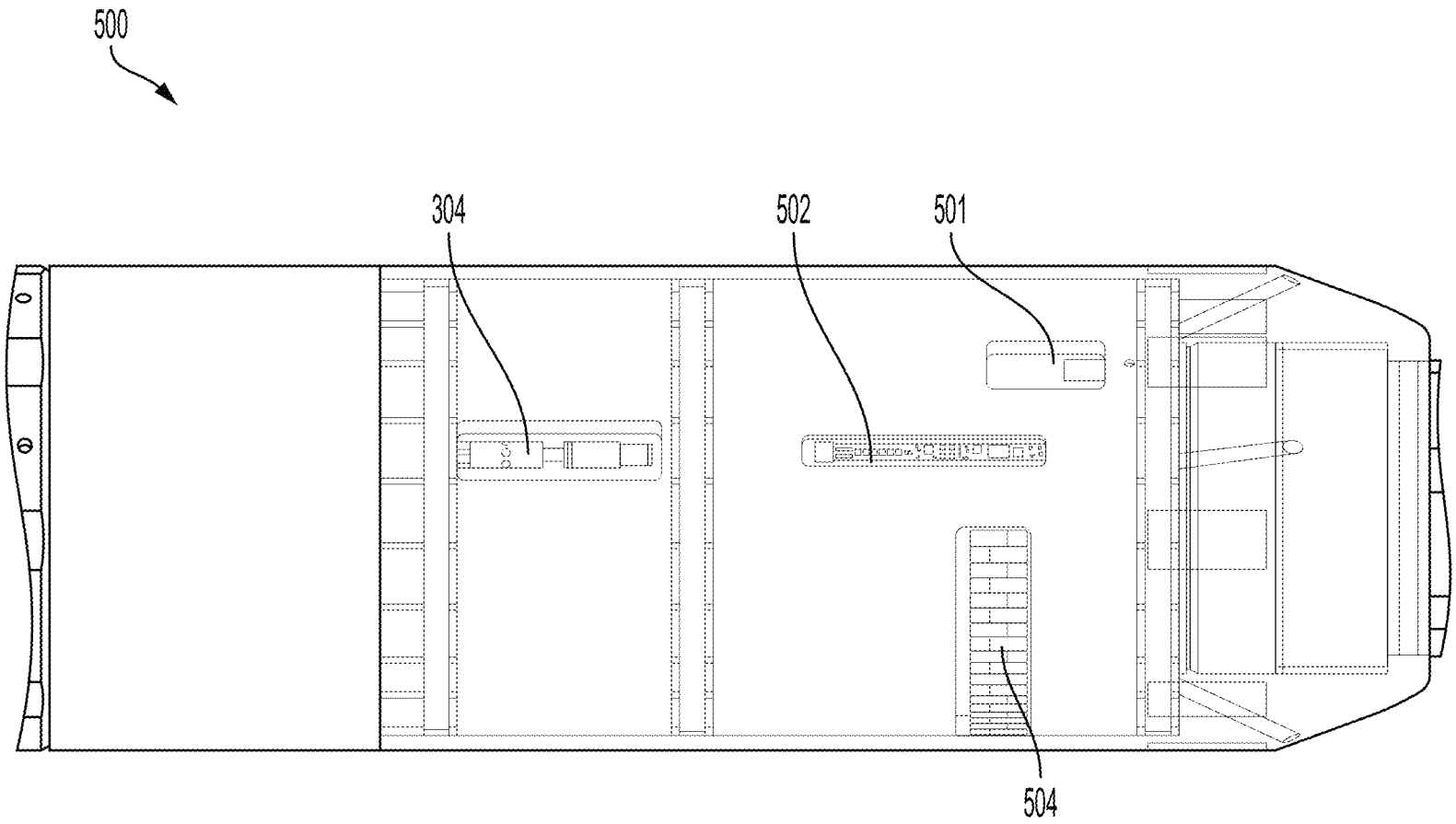
FIG. 5 is a sectional side-view of electrical components of a setting module of a remotely operable retrievable downhole tool according to one example of the present disclosure.

FIG. 5 is a sectional side-view of electrical components 500 of a setting module 104 of a remotely operable retrievable downhole tool 102 according to one example of the present disclosure. The electrical components 500 can include a sensor 501, an electronic control device 502, and a power source 504. The sensor 501 can include a pressure transducer, flowrate sensor, or other suitable sensor for detecting pressure or flowrates with respect to the retrievable downhole tool 102. The sensor 501 can be positioned on an exterior surface 206 of the retrievable downhole tool 102, on an interior surface of the retrievable downhole tool 102, or in other suitable locations with respect to the retrievable downhole tool 102. In some examples, the sensor 501 can be positioned in the retrievable downhole tool 102 such that the sensor 501 can receive tubing pressure signals (e.g., from the interior region 212), annulus pressure signals (e.g., from the exterior surface 206), or a combination thereof. Accordingly, the sensor 501 can detect a differential pressure between the exterior surface 206 and the interior region 212 of the retrievable downhole tool 102.

The electronic control device 502 can be positioned in any suitable location with respect to the remotely operable retrievable downhole tool 102 (e.g., the exterior surface 206, an interior surface, in between the exterior surface 206 and the interior surface, etc.). The electronic control device 502 can be communicatively coupled to the sensor 501, the pump assembly 304, other suitable components, or a combination thereof. The power source 504 can include batteries or other suitable portable sources of power. In some examples, the power source 504 can include, or can be coupled to, wired power sources such as electrical cables from the surface 101 of the wellbore 100, etc. The power source 504 can be electrically, or otherwise suitably, coupled to the sensor 501, the electronic control device 502, the pump assembly 304, other suitable components of the retrievable downhole tool 102, or a combination thereof. The power source 504 can provide electricity or other suitable power to the components of the retrievable downhole tool 102.

The sensor 501 can communicate with the electronic control device 502. For example, the sensor 501 can continuously monitor or otherwise detect sequences of pressure or flowrate in the retrievable downhole tool 102 and can transmit the detected sequences of pressure or flowrate to the electronic control device 502. The sequences of pressure or flowrate can include a triggering pressure or flowrate sequence, which can be caused by a change in fluid flow rate. In response to receiving the triggering pressure sequence, the electronic control device 502 can generate a control signal or command. The triggering pressure sequence can cause the sensor 501 to transmit a predetermined signal or sequence of signals that can cause the electronic control device 502 to generate the command. The electronic control device 502 can transmit the control signal command to the pump assembly 304, and the command can cause the pump assembly 304 to displace fluid in the piston 302 for actuating the mechanical slip assembly 202 into the pre-set configuration. The control signal or command can cause the pump assembly 304 to run for a predetermined amount of time, and, subsequent to the predetermined amount of time, the pump assembly 304 may shut off until receiving an additional control signal or command.

In some examples, more than one remotely operable retrievable downhole tool 102 can be positioned in the wellbore 100. In these examples, the retrievable downhole tools 102 can be positioned on a common workstring and can each include a setting module 104. The setting module 104 can allow the retrievable downhole tools 102 to be set individually. For example, a first retrievable downhole tool can receive a first triggering pressure sequence that causes the first retrievable downhole tool to be set while leaving a second retrievable downhole tool in a RIH configuration. Accordingly, the setting module 104 can prevent accidental setting of retrievable downhole tools 102 positioned on the common workstring.

Figure 6:
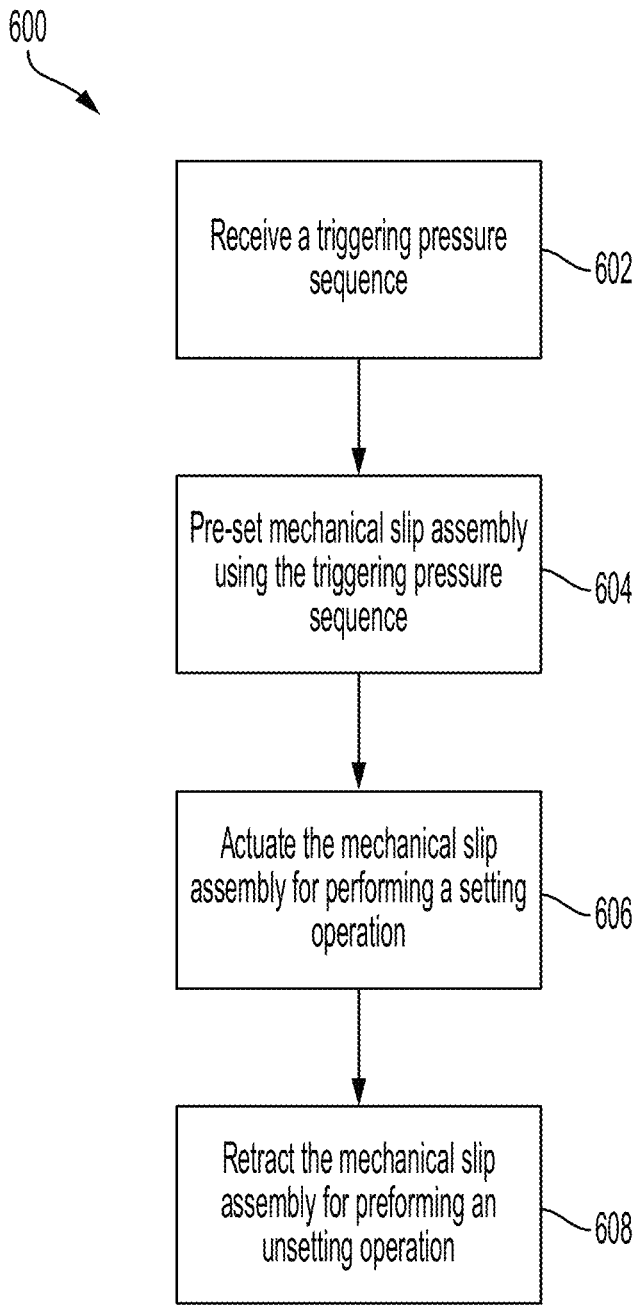
FIG. 6 is a flow chart of a process to set a remotely operable retrievable downhole tool according to one example of the present disclosure.

FIG. 6 is a flow chart of a process to set a remotely operable retrievable downhole tool according to one example of the present disclosure. At block 602, the retrievable downhole tool 102 receives a triggering pressure sequence. The triggering pressure sequence can be generated at the surface of the wellbore 100 or using other suitable techniques. The triggering pressure sequence can be generated by altering or varying fluid flow rates in the wellbore 100. The setting module 104 of the remotely operable retrievable downhole tool 102 can receive the triggering pressure sequence. For example, the sensor 501 can detect minor changes in the pressure of fluid surrounding (or within) the remotely operable retrievable downhole tool 102. The sensor 501 may continuously or periodically communicate with the electronic control device 502. For example, the sensor 501 can continuously or periodically transmit pressure or flowrate signals to the electronic control device 502. The electronic control device 502 can be programmed to detect the triggering pressure sequence, which can include a predetermined pressure or sequence of pressures, and, in response to receiving the triggering pressure sequence, the electronic control device 502 can transmit a control signal or command to the motor 406.

At block 604, the retrievable downhole tool 102 pre-sets the mechanical slip assembly 202 using the triggering pressure sequence. In response to receiving the control signal or command, the motor 406 can control the pump 410 for actuating the mechanical slip assembly 202. For example, the pump 410 can displace fluid in the piston 302, which can cause the slip guide 301 to displace and actuate the mechanical slips 106 outward. In some examples, the pump 410 can apply hydraulic force on the piston 302, the mechanical slip assembly 202, other suitable components of the retrievable downhole tool 102, or a combination thereof, for actuating the mechanical slip assembly 202. The pump 410 can cause the mechanical slip assembly 202 to move into a pre-set configuration. The pre-set configuration can involve partially actuating the mechanical slip assembly 202 such that the mechanical slips 106 contact the casing 108 or the wall 110 of the wellbore 100 but may not apply a large enough force to set the retrievable downhole tool 102.

At block 606, the retrievable downhole tool 102 actuates the mechanical slip assembly 202 to perform a setting operation. The setting operation can involve moving or otherwise adjusting the remotely operable retrievable downhole tool 102 into a set configuration. The set configuration can include the mechanical slips 106 actuated and applying a setting force on the casing 108 or the wall 110 of the wellbore 100. The retrievable downhole tool 102 can receive a setting weight from the surface 101 or from other suitable sources for the setting weight. The retrievable downhole tool 102 can use the setting weight to actuate the mechanical slips 106. For example, the retrievable downhole tool 102 can apply the setting weight to the slip guide 301 of the mechanical slip assembly 202 to cause the mechanical slips 106 to actuate outward for applying the setting force on the casing 108 or the wall 110 of the wellbore 100. In response to receiving the setting weight and actuating the mechanical slip assembly 202, the retrievable downhole tool 102 can be used to perform one or more wellbore operations.

At block 608, the retrievable downhole tool 102 retracts the mechanical slip assembly 202 for performing an unsetting operation. In response to completing or otherwise halting the wellbore operations, the retrievable downhole tool 102 can retract the mechanical slip assembly 202. By retracting the mechanical slip assembly 202, the retrievable downhole tool 102 may return the mechanical slip assembly 202 to a RIH configuration in which the mechanical slip assembly 202 is not actuated. In some examples, the retrievable downhole tool 102 may retract the mechanical slip assembly 202 in response to the setting weight being removed from the retrievable downhole tool 102. For example, an operator at the surface 101 can remove the setting weight from the retrievable downhole tool 102, and removing the setting weight can cause the spring 308 to apply a spring force on the piston 302, the mechanical slip assembly 202, other suitable components of the retrievable downhole tool 102, or a combination thereof. By applying the spring force, the spring 308 can return the mechanical slip assembly 202 to the RIH configuration. The retrievable downhole tool 102 can repeatedly perform setting and unsetting operations in the wellbore 100 via the process 600.

In some aspects, setting modules, methods, and assemblies for a remotely operable retrievable downhole tool with a setting module are provided according to one or more of the following examples.

As used below, any reference to a series of examples is to be understood as a reference to each of those examples disjunctively (e.g., "Examples 1-4" is to be understood as "Examples 1, 2, 3, or 4").

Example 1 is a setting module for setting a packer assembly in a wellbore, the setting module comprising: a motor; a sensor to detect pressure of fluid from a surface of the wellbore and output detected pressure to an electronic control device; and the electronic control device to detect a triggering pressure sequence of the fluid from the surface and to, in response to detecting the triggered pressure sequence, output a command to the motor to drive a pump to cause a slip to move for setting the packer assembly.

Example 2 is the setting module of example 1, further comprising: a power source electrically coupled to at least the motor; the pump, wherein the pump is positioned on an external surface of the packer assembly, wherein the pump is positioned between the motor and a piston, and wherein the pump is coupled to the motor; the piston, wherein the piston is positioned between the pump and a mechanical slip assembly, wherein the piston comprises internal fluid, and wherein the piston is operably coupled to the pump; a spring positioned adjacent to and within the piston; and the mechanical slip assembly comprising: a slip guide positioned on the external surface of the packer assembly, wherein the slip guide is positioned adjacent to the slip and between the slip and the piston; and the slip, wherein the slip is positioned on the external surface of the packer assembly and adjacent to the piston.

Example 3 is the setting module of any of examples 1-2, wherein the internal fluid is displaceable by the pump to actuate the slip guide for actuating the slip, and wherein the slip is positioned in the packer assembly such that, in response to actuating, the slip is moveable to contact a wall of the wellbore to set the packer assembly in the wellbore.

Example 4 is the setting module of any of examples 1-2, wherein the power source includes a battery positioned on the packer assembly for providing power to the motor.

Example 5 is the setting module of example 1, wherein the sensor includes a pressure transducer or a flowrate sensor, wherein a differential pressure between an outer diameter of the setting module and an inner diameter of the setting module is detectable by the sensor, and wherein the pressure of the fluid from the surface of the wellbore is detectable by the sensor in the inner diameter of the setting module.

Example 6 is the setting module of example 1, wherein the triggering pressure sequence is programmable prior to positioning the packer assembly in the wellbore, wherein the packer assembly is a first packer assembly, and wherein the first packer assembly and a second packer assembly are individually settable in the wellbore.

Example 7 is the setting module of any of examples 1 and 6, wherein the triggering pressure sequence is a first triggering pressure sequence and the setting module is a first setting module, wherein the first triggering pressure sequence is usable via the first setting module to set the first packer assembly and a second triggering pressure sequence is usable via a second setting module to set a second packer assembly.

Example 8 is a method comprising: receiving, via a sensor of a setting module, a triggering pressure sequence from a surface of a wellbore; pre-setting, via the setting module, a mechanical slip assembly by using the triggering pressure sequence to output a command to a motor to drive a pump to cause a slip of the mechanical slip assembly to move; actuating, via the setting module, the mechanical slip assembly for performing a setting operation in the wellbore; and retracting, via the setting module, the mechanical slip assembly for performing an unsetting operation in the wellbore.

Example 9 is the method of example 8, wherein the setting module includes: a power source electrically coupled to at least the motor; the pump, wherein the pump is positioned on an external surface of a packer assembly, wherein the pump is positioned between the motor and a piston, and wherein the pump is coupled to the motor; the piston, wherein the piston is positioned between the pump and a mechanical slip assembly, wherein the piston comprises internal fluid, and wherein the piston is operably coupled to the pump; a spring positioned adjacent to and within the piston; and the mechanical slip assembly comprising: a slip guide positioned on the external surface of the packer assembly, wherein the slip guide is positioned adjacent to the slip and between the slip and the piston; and the slip, wherein the slip is positioned on the external surface of the packer assembly and adjacent to the piston.

Example 10 is the method of any of examples 8-9, wherein pre-setting the mechanical slip assembly includes displacing, via the pump, the internal fluid to actuate the slip guide for actuating the slip, and wherein actuating the mechanical slip assembly for performing the setting operation in the wellbore includes contacting, via the slip, a wall of the wellbore to set the packer assembly in the wellbore.

Example 11 is the method of any of examples 8-9, wherein the power source includes a battery positioned on the packer assembly for providing power to the motor.

Example 12 is the method of example 8, wherein receiving the triggering pressure sequence from the surface of the wellbore includes detecting, via the sensor, a differential pressure between an outer diameter of the setting module and an inner diameter of the setting module, and wherein the sensor includes a pressure transducer or a flowrate sensor.

Example 13 is the method of example 8, wherein the triggering pressure sequence is programmed prior to positioning a packer assembly in the wellbore, wherein the packer assembly is a first packer assembly, further comprising individually setting the first packer assembly and a second packer assembly in the wellbore.

Example 14 is the method of any of examples 8 and 13, wherein the triggering pressure sequence is a first triggering pressure sequence and the setting module is a first setting module, and wherein individually setting the first packer assembly and the second packer assembly in the wellbore includes setting, using the first setting module, the first packer assembly using the first triggering pressure sequence and setting, using a second setting module, the second packer assembly using a second triggering pressure sequence.

Example 15 is an assembly comprising: a packer assembly; one or more slips; and a setting module comprising: a motor; a sensor to detect pressure of fluid from a surface of a wellbore and output detected pressure to an electronic control device; and the electronic control device to detect a triggering pressure sequence of the fluid from the surface and to, in response to detecting the triggered pressure sequence, output a command to the motor to drive a pump to cause the slips to move for setting the packer assembly.

Example 16 is the assembly of example 15, further comprising: a power source electrically coupled to at least the motor; the pump, wherein the pump is positioned on an external surface of the packer assembly, wherein the pump is positioned between the motor and a piston, and wherein the pump is coupled to the motor; the piston, wherein the piston is positioned between the pump and a mechanical slip assembly, wherein the piston comprises internal fluid, and wherein the piston is operably coupled to the pump; a spring positioned adjacent to and within the piston; and the mechanical slip assembly comprising: a slip guide positioned on the external surface of the packer assembly, wherein the slip guide is positioned adjacent to the one or more slips and between the one or more slips and the piston; and the one or more slips, wherein the one or more slips are positioned on the external surface of the packer assembly and adjacent to the piston.

Example 17 is the assembly of any of examples 15-16, wherein the internal fluid is displaceable by the pump to actuate the slip guide for actuating the one or more slips, and wherein the one or more slips are positioned in the packer assembly such that, in response to actuating, the one or more slips are movable to contact a wall of the wellbore to set the packer assembly in the wellbore.

Example 18 is the assembly of any of examples 15-16, wherein the power source includes a battery positioned on the packer assembly for providing power to the motor.

Example 19 is the assembly of example 15, wherein the sensor includes a pressure transducer or a flowrate sensor, wherein a differential pressure between an outer diameter of the setting module and an inner diameter of the setting module is detectable by the sensor, and wherein the pressure of the fluid from the surface of the wellbore is detectable by the sensor in the inner diameter of the setting module.

Example 20 is the assembly of example 15, wherein the triggering pressure sequence is programmable prior to positioning the packer assembly in the wellbore, wherein the packer assembly is a first packer assembly, the triggering pressure sequence is a first triggering pressure sequence and the setting module is a first setting module, wherein the first triggering pressure sequence is usable via the first setting module to set the first packer assembly and a second triggering pressure sequence is usable via a second setting module to set a second packer assembly, and wherein the first packer assembly and the second packer assembly are individually settable in the wellbore.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A setting module for setting a packer assembly in a wellbore, the setting module comprising:

a motor;

a sensor to detect pressure of fluid from a surface of the wellbore and output detected pressure to an electronic control device; and the electronic control device to detect a triggering pressure sequence of the fluid from the surface and to, in response to detecting the triggered pressure sequence, output a command to the motor to drive a pump to cause a slip of the packer assembly to move into a pre-set configuration in which the slip contacts a wall of the wellbore prior to the packer assembly setting in the wellbore via a mechanical setting force upstream in the wellbore from the packer assembly, wherein the pressure of the fluid from the surface of the wellbore is detectable by the sensor in an inner diameter of the setting module.

2. The setting module of claim 1, further comprising:

a power source electrically coupled to at least the motor;

the pump, wherein the pump is positioned on an external surface of the packer assembly, wherein the pump is positioned between the motor and a piston, and wherein the pump is coupled to the motor;

the piston, wherein the piston is positioned between the pump and a mechanical slip assembly, wherein the piston comprises internal fluid, and wherein the piston is operably coupled to the pump;

a spring positioned adjacent to and within the piston; and the mechanical slip assembly comprising:

a slip guide positioned on the external surface of the packer assembly, wherein the slip guide is positioned adjacent to the slip; and the slip, wherein the slip is positioned on the external surface of the packer assembly and adjacent to the piston.

3. The setting module of claim 2, wherein the internal fluid is displaceable by the pump to actuate the slip guide for actuating the slip, and wherein the slip is positioned in the packer assembly such that, in response to actuating, the slip is moveable to contact a wall of the wellbore to set the packer assembly in the wellbore.

4. The setting module of claim 2, wherein the power source includes a battery positioned on the packer assembly for providing power to the motor.

5. The setting module of claim 1, wherein the sensor includes a pressure transducer or a flowrate sensor, and wherein a differential pressure between an outer diameter of the setting module and the inner diameter of the setting module is detectable by the sensor.

6. The setting module of claim 1, wherein the triggering pressure sequence is programmable prior to positioning the packer assembly in the wellbore, wherein the packer assembly is a first packer assembly, and wherein the first packer assembly and a second packer assembly are individually settable in the wellbore.

7. The setting module of claim 6, wherein the triggering pressure sequence is a first triggering pressure sequence and the setting module is a first setting module, wherein the first triggering pressure sequence is usable via the first setting module to set the first packer assembly and a second triggering pressure sequence is usable via a second setting module to set a second packer assembly.

8. A method comprising:

receiving, via a sensor of a setting module of a packer assembly, a triggering pressure sequence from a surface of a wellbore by detecting the triggering pressure sequence in an inner diameter of the setting module;

pre-setting, via the setting module, a mechanical slip assembly by using the triggering pressure sequence to output a command to a motor to drive a pump to cause a slip of the mechanical slip assembly to move to contact a wall of the wellbore in a pre-set configuration of the packer assembly that is prior to the packer assembly setting in the wellbore;

actuating, via the packer assembly and in response to receiving a mechanical setting force upstream in the wellbore from the packer assembly, the mechanical slip assembly for performing a setting operation in the wellbore; and retracting, via the packer assembly and in response to having the mechanical setting force removed from the packer assembly, the mechanical slip assembly for performing an unsetting operation in the wellbore.

9. The method of claim 8, wherein the setting module includes:

a power source electrically coupled to at least the motor;

the pump, wherein the pump is positioned on an external surface of the packer assembly, wherein the pump is positioned between the motor and a piston, and wherein the pump is coupled to the motor;

the piston, wherein the piston is positioned between the pump and a mechanical slip assembly, wherein the piston comprises internal fluid, and wherein the piston is operably coupled to the pump;

a spring positioned adjacent to and within the piston; and the mechanical slip assembly comprising:

a slip guide positioned on the external surface of the packer assembly, wherein the slip guide is positioned adjacent to the slip; and the slip, wherein the slip is positioned on the external surface of the packer assembly and adjacent to the piston.

10. The method of claim 9, wherein pre-setting the mechanical slip assembly includes displacing, via the pump, the internal fluid to actuate the slip guide for actuating the slip, and wherein actuating the mechanical slip assembly for performing the setting operation in the wellbore includes contacting, via the slip, a wall of the wellbore to set the packer assembly in the wellbore.

11. The method of claim 9, wherein the power source includes a battery positioned on the packer assembly for providing power to the motor.

12. The method of claim 8, wherein receiving the triggering pressure sequence from the surface of the wellbore includes detecting, via the sensor, a differential pressure between an outer diameter of the setting module and an inner diameter of the setting module, and wherein the sensor includes a pressure transducer or a flowrate sensor.

13. The method of claim 8, wherein the triggering pressure sequence is programmed prior to positioning the packer assembly in the wellbore, wherein the packer assembly is a first packer assembly, further comprising individually setting the first packer assembly and a second packer assembly in the wellbore.

14. The method of claim 13, wherein the triggering pressure sequence is a first triggering pressure sequence and the setting module is a first setting module, and wherein individually setting the first packer assembly and the second packer assembly in the wellbore includes setting, using the first setting module, the first packer assembly using the first triggering pressure sequence and setting, using a second setting module, the second packer assembly using a second triggering pressure sequence.

15. An assembly comprising:

a packer assembly;

one or more slips; and a setting module comprising:

a motor;

a sensor to detect pressure of fluid from a surface of a wellbore and output detected pressure to an electronic control device; and the electronic control device to detect a triggering pressure sequence of the fluid from the surface and to, in response to detecting the triggered pressure sequence, output a command to the motor to drive a pump to cause a slip of the packer assembly to move into a pre-set configuration in which the slip contacts a wall of the wellbore prior to the packer assembly setting in the wellbore via a mechanical setting force upstream in the wellbore from the packer assembly, wherein the pressure of the fluid from the surface of the wellbore is detectable by the sensor in an inner diameter of the setting module.

16. The assembly of claim 15, further comprising:

a power source electrically coupled to at least the motor;

the pump, wherein the pump is positioned on an external surface of the packer assembly, wherein the pump is positioned between the motor and a piston, and wherein the pump is coupled to the motor;

the piston, wherein the piston is positioned between the pump and a mechanical slip assembly, wherein the piston comprises internal fluid, and wherein the piston is operably coupled to the pump;

a spring positioned adjacent to and within the piston; and the mechanical slip assembly comprising:

a slip guide positioned on the external surface of the packer assembly, wherein the slip guide is positioned adjacent to the one or more slips; and the one or more slips, wherein the one or more slips are positioned on the external surface of the packer assembly and adjacent to the piston.

17. The assembly of claim 16, wherein the internal fluid is displaceable by the pump to actuate the slip guide for actuating the one or more slips, and wherein the one or more slips are positioned in the packer assembly such that, in response to actuating, the one or more slips are movable to contact a wall of the wellbore to set the packer assembly in the wellbore.

18. The assembly of claim 16, wherein the power source includes a battery positioned on the packer assembly for providing power to the motor.

19. The assembly of claim 15, wherein the sensor includes a pressure transducer or a flowrate sensor, wherein a differential pressure between an outer diameter of the setting module and the inner diameter of the setting module is detectable by the sensor.

20. The assembly of claim 15, wherein the triggering pressure sequence is programmable prior to positioning the packer assembly in the wellbore, wherein the packer assembly is a first packer assembly, the triggering pressure sequence is a first triggering pressure sequence and the setting module is a first setting module, wherein the first triggering pressure sequence is usable via the first setting module to set the first packer assembly and a second triggering pressure sequence is usable via a second setting module to set a second packer assembly, and wherein the first packer assembly and the second packer assembly are individually settable in the wellbore.

* * * * *